United States Patent [19]

Postma et al.

[11] Patent Number: 4,661,746

[45] Date of Patent: Apr. 28, 1987

[54] ELECTRODELESS LOW-PRESSURE DISCHARGE LAMP

[75] Inventors: Pieter Postma; Johannes A. J. M. van Vliet, both of Eindhoven, Netherlands

[73] Assignee: U.S. Philips Corporation, New York, N.Y.

[21] Appl. No.: 741,061

[22] Filed: Jun. 5, 1985

[30] Foreign Application Priority Data

Jun. 14, 1984 [NL] Netherlands ..... 8401878

[51] Int. Cl.[4] ..... H05B 41/16

[52] U.S. Cl. ..... 315/248; 315/39; 315/344; 313/488

[58] Field of Search ..... 315/248, 39, 344; 336/175; 313/34, 488

[56] References Cited

U.S. PATENT DOCUMENTS

| | | | |
|---|---|---|---|
| 2,974,243 | 3/1961 | Marrison | 315/248 |
| 3,196,312 | 7/1965 | Marrison | 315/248 |
| 4,024,431 | 5/1977 | Young | 315/248 |
| 4,119,889 | 10/1978 | Hollister | 315/248 |
| 4,189,661 | 2/1980 | Haugsjaa et al. | 315/248 |
| 4,266,167 | 5/1981 | Proud et al. | 315/248 |

FOREIGN PATENT DOCUMENTS

| | | | |
|---|---|---|---|
| 0004381 | 1/1978 | Japan | 315/248 |

*Primary Examiner*—David K. Moore
*Assistant Examiner*—Mike Razavi
*Attorney, Agent, or Firm*—David R. Treacy

[57] ABSTRACT

An electrodeless low-pressure discharge lamp comprising a lamp vessel (1) sealed in a vacuum-tight manner and filled at least with a metal vapor and a rare gas, the lamp being provided also with a cylindrical core (2) of magnetic material, such as ferrite, a winding (4) arranged to surround the core (2) and an electrical supply unit connected thereto for producing during operation of the lamp an electrical field in the lamp vessel (1). The supply unit is located in a thin-walled metal housing (8) provided in a wall portion (9) of synthetic material, which is partly of conical shape and is provided at its end with an Edison lamp cap (10), and the core (2) accommodates a rod-shaped or tubular body (11) of thermally conducting material connected to the housing (8). In order to improve the ignition properties of the lamp, an electrical insulator (12) is provided between the end of the body (11) and the wall of the housing (8).

8 Claims, 2 Drawing Figures

ELECTRODELESS LOW-PRESSURE DISCHARGE LAMP

Figure 1:
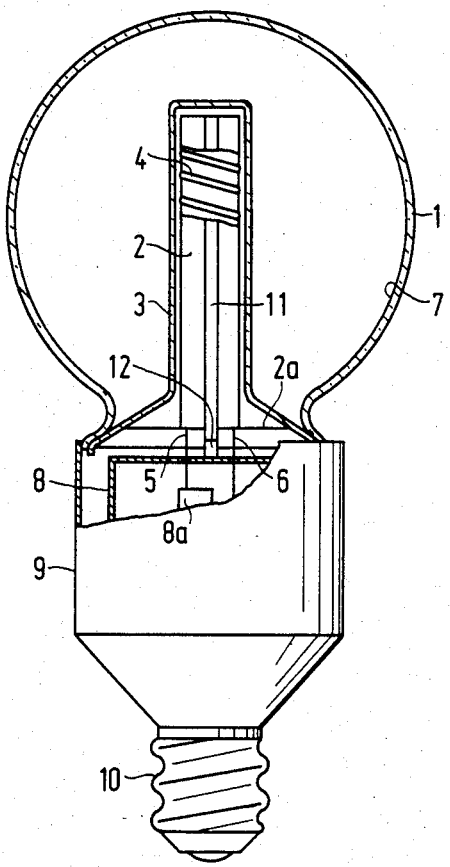

The invention relates to an electrodeless low-pressure discharge lamp comprising a lamp vessel which is sealed in a gas tight manner and is filled at least with a metal vapour and a rare gas, and an electrical supply unit which is connected to a winding around a cylindrical core of magnetic material for producing during operation an electrical field in the lamp vessel, said supply unit being located in a metal housing forming part of the lamp and said core of magnetic material accommodating a rod-shaped body of thermally conducting material which is connected to the housing.

Such a lamp is known from the Netherlands patent application No. 8104233 laid open to public inspection to which U.S. Pat. No. 4,536,675 corresponds.

This lamp is preferably operated with a supply voltage having a frequency exceeding about 20 kHz and serves as an alternative to an incandescent lamp for general illumination purposes. The magnetic core is located in a cylindrical indentation in the wall of the lamp vessel near the longitudinal axis of the lamp.

During operation of the lamp, the temperature of the core of magnetic material increases due to the heat developed in the discharge. In order to prevent the temperature in the core increasing to an excessively high value, a thermally conducting body is present in the core of the known lamp, the heat being dissipated preferably to the ambient surrounding the lamp as soon as possible. The thermally conducting body (consisting, for example, of a copper rod) is secured on its lower side to the wall of the metal housing (for example by means of a soldering connection) which accommodates the electrical supply unit. In an embodiment, said housng is surrounded by a slightly conical wall portion of synthetic material provided at its tapering end with an Edison-lamp cap and secured at its other end to the lamp vessel.

It has been found that especially in this embodiment of the lamp, in which the metal housing is also connected during operation of the lamp to one of the lead-in conductors of the supply mains (for suppression of the electrical interference at this mains), the ignition voltage of the lamp compared with a lamp without a thermally conducting rod is too high for satisfactory operation of the lamp.

The invention has for its object to provide a lamp of the kind mentioned in the opening paragraph in which this disadvantage is avoided to a considerable extent.

According to the invention, such a lamp is for this purpose characterized in that the part of the thermally conducting body located at the area of the winding is electrically insulated from the metal housing accommodating the electrical supply unit.

Experiments have shown that due to the presence of the electrically insulating material (for example consisting of a synthetic material or of glass wool) the ignition voltage of the lamp is considerably lower than that of the lamp according to the aforementioned Netherlands published Patent Application. In an embodiment, this ignition voltage reduction amounts to about 15%. It has further been found that in spite of the presence of the insulator no additional steps are required for dissipating the heat developed in the magnetic core. In fact it has been found that the temperature of the magnetic material (such as a ferrite), measured throughout the length of the core, lies well below the critical value due to the presence of the rod of thermally conducting material. Above the critical temperature value, the permeability of the magnetic material strongly decreases and the lamp extinguishes.

The invention is in particular of advantage in a lamp in which the wall of the metal housing is connected during operation of the lamp to one of the lead-in wires of the supply mains for suppression of interference currents at the supply mains generated by the lamp.

The electrical insulator consists, for example, of a layer of synthetic material located between two parts of the thermally conducting body. In an embodiment the first part of this body extends near the winding and the second part extends near the lower end of the core of magnetic material.

Preferably, however, the said electrical insulator is located between the lower side of the rod-shaped thermally conducting body and the wall of the metal housing. A homogeneous heat distribution is then obtained throughout the length of the core. Due to the fact that the heat conductor is arranged in the core as an integral part, such a lamp can also be manufactured in a comparatively simple manner.

In a particular embodiment, the electrical insulator is an insulating layer extending in a space present between the wall of the lamp vessel and the wall of the housing facing the lamp vessel, the said layer further being thermally insulating. Besides the fact that a lamp is obtained having the aforementioned favourable ignition properties, it is prevented that due to the heat developed in the lamp vessel the temperature in the housing increases to a high value.

At such temperatures there is in fact the risk that the components forming part of the electrical circuit of the supply unit are damaged by the heat.

Figure 2:
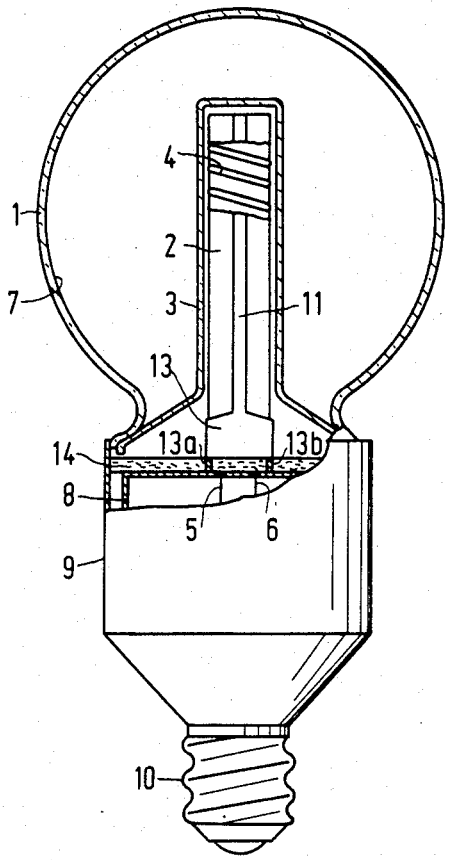

Embodiments of the invention will now be described more fully with reference to the accompanying drawing. In the drawing:

FIG. 1 shows diagrammatically, partly in elevation and partly in sectional view, a first embodiment of an electrodeless low-pressure mercury vapour discharge lamp according to the invention, and FIG. 2 shows a second embodiment of an electrodeless low-pressure mercury vapour discharge lamp according to the invention.

The lamp shown in FIG. 1 comprises a bulb-shaped lamp vessel 1 which is sealed in a gas-tight manner and filled with mercury and a rare gas, such as argon. The lamp is further provided with a cylindrical core 2 of magnetic material (such as ferrite), this core being located in a tubular indentation 3 in the wall of the lamp vessel 1. During operation of the lamp, a high frequency magnetic field is produced by means of a winding 4 (consisting of a number of turns of copper wire) arranged to surround the core and connected through the wires 5 and 6 (partly visible in the drawing) to a high-frequency electrical supply unit. This field also extends into the lamp vessel, an electrical field being obtained in situ and ultraviolet resonance radiation being produced. By means of the luminescent layer 7 present on the inner wall of the lamp vessel, this radiation is converted into visible light.

The electrical supply unit is located in a thin-walled metal housing 8 which is disposed in a wall portion 9 of synthetic material which is secured to the lamp vessel, is partly of conical shape and carries at its end an Edison lamp cap 10 so that the lamp can be screwed into a fitting intended for incandescent lamps. The electrical supply unit comprises an electrical circuit (see Netherlands patent application No. 8004175 laid open to public inspection to which U.S. Pat. No. 4,415,838 corresponds; the circuit is indicated diagrammatically by 8*a*).

The core 2 accommodates a tubular body 11 of copper for dissipating heat from the core during operation of the lamp. This body 11 is connected to the wall of the metal housing 8 facing the lamp vessel, an electrical insulator 12 being disposed between the lower side of the body and the upper side wall of the metal housing 8. Said housing 8 and a transparent layer not visible in the drawing disposed between the luminescent layer 7 and the glass wall of the lamp vessel are connected during operation of the lamp to one of the lead-in conductors of the supply mains for suppression of interference currents at the mains (see Netherlands patent application No. 8205025, laid open to public inspection to which U.S. Pat. No. 4,568,859 corresponds).

By means of the electrical insulator 12, which consists of a cylinder of synthetic material, for example, a polycarbonate, having the same outer diameter as the body 11, the part of the thermally conducting body at the area of the winding 4 is electrically insulated from the metal housing 8 containing the electrical circuit. As a result, a considerable reduction of the ignition voltage of the lamp is attained compared with a lamp without insulation. For example, in a lamp (power 13 W) according to the invention, the ignition voltage was 175 V at a rare gas pressure of 4 torr (argon). In the known lamp (also 13 W), the ignition voltage was 200 V.

The cylindrical core of magnetic material is secured to the lower side of the outer wall of the lamp vessel by means of supporting members, one of which is designated, by way of example, by 2*a*. The body 11 is clamped in the core. The body 11 is longer than the core 2 and slightly projects on the lower side. The said insulator 12 of synthetic material is secured by means of glue to the lower side of the body 11 and to the upper side of the housing 8, respectively.

In the lamp shown in FIG. 2, the reference numerals relating to the same components as in the lamp shown in FIG. 1 are the same. In the lamp, the thermally conducting body extends beyond the end of the core 2 facing the lamp cap 10, this thermally conducting body 11 being provided in situ with a thickened part 13. The heat dissipation from the part of the core located near the winding 4 is then very favourable. Furthermore, there is provided between the lower side of the thermally conducting body and the wall of the metal housing 8 facing the lamp vessel a layer of glass wool 14, which extends between the wall of the metal housing 8 and the lower side of the lamp vessel; this layer is not only electrically insulating, but also thermally insulating. As a result, the temperature of the components of the electrical supply unit located in the housing are prevented from increasing to an undesirably high value due to thermal radiation originating from the lamp vessel. Also in this embodiment of the lamp according to the invention, the thermally conducting body 11 (consisting of a solid copper rod) is clamped in the core 2. The outer diameter of the part 13 of the body substantially corresponds to the outer diameter of the core 2. The body 11 is secured to the housing by means of a number of small rods of synthetic material. In a practical embodiment, four of such rods are present. In the drawing, two rods (13*a* and 13*b*) are visible.

Experiments with the lamp according to FIG. 2 have shown that with a power supply of 13 W to the lamp, a frequency of the supply voltage of about 2.65 MHz, a maximum diameter of the bulb-shaped lamp vessel of 75 mm and a length of 90 mm, a cylindrical core having a length of 50 mm and a diameter of 8 mm and a thermally conducting rod (solid copper) having a length of 60 mm and a diameter of the narrower part of 3.5 mm, the measured luminous flux was 1200 lumen. The winding comprised thirteen turns of copper wire having a thickness of about 0.2 mm. The core consisted of "Philips 4C6" ferrite. The layer of glass wool had a thickness of 0.5 cm and a density of about 1 g/cm$^3$. The ignition voltage reduction of this lamp was about 25 V (from 200 to 175 V).

It has been found that during operation of the lamp the temperature of the thermally conducting rod was about 170° C. The temperature of the components (such as resistors, capacitors and transistors) located in the housing was about 100° C. A highly temperature-sensitive electrolytic capacitor located below the housing 8 (not visible in the drawing) and forming part of the supply circuit, has been found to have a temperature of only 79° C. At such a temperature the operation of this capacitor is not adversely affected.

What is claimed is

1. An electrodeless low-pressure discharge lamp comprising a lamp vessel which is sealed in a gastight manner and is filled at least with a metal vapour and a rare gas and an electrical supply unit which is connected to a winding around a cylindrical core of magnetic material for producing during operation an electrical field in the lamp vessel, said supply unit being located in a metal housing forming part of the lamp, and said core of magnetic material accommodating a rod-shaped body of thermally conducting material connected to the housing, characterized in that the part of the thermally conducting body located at the area of the winding is electrically insulated from the metal housing accommodating the electrical supply unit.

2. An electrodeless low-pressure discharge lamp as claimed in claim 1, characterized in that an electrical insulator is provided between the lower side of the thermally conducting body and the wall of the metal housing.

3. An electrodeless low-pressure discharge lamp as claimed in claim 2, characterized in that the electrical insulator comprises a layer which extends between the wall of the metal housing facing the lamp vessel and the lower side of the lamp vessel, this layer further being thermally insulating.

4. An electrodeless low-pressure discharge lamp as claimed in claim 3, characterized in that the thermally conducting body extends beyond the end of the cylindrical core facing the metal housing, this thermally conducting body being provided in situ with a thickened part.

5. An electrodeless low-pressure discharge lamp as claimed in claim 4, characterized in that the electrical insulator consists of a cylinder of synthetic material disposed between the end of the body and the housing.

6. An electrodeless low-pressure discharge lamp as claimed in claim 2, characterized in that the electrical insulator consists of a cylinder of synthetic material disposed between the end of the body and the housing.

7. An electrodeless low-pressure discharge lamp as claimed in claim 2, characterized in that the thermally conducting body extends beyond the end of the cylindrical core facing the metal housing, this thermally conducting body being provided in situ with a thickened part.

8. An electrodeless low-pressure discharge lamp as claimed in claim 1, characterized in that the thermally conducting body extends beyond the end of the cylindrical core facing the metal housing, this thermally conducting body being provided in situ with a thickened part.

* * * * *